US009448050B1

(12) United States Patent
Barwin

(10) Patent No.: US 9,448,050 B1
(45) Date of Patent: Sep. 20, 2016

(54) GUN MAGAZINE ASSEMBLY

(71) Applicant: David George Barwin, Lakewood, CO (US)

(72) Inventor: David George Barwin, Lakewood, CO (US)

( * ) Notice: Subject to any disclaimer, the term of this patent is extended or adjusted under 35 U.S.C. 154(b) by 0 days.

(21) Appl. No.: 14/624,309

(22) Filed: Feb. 17, 2015

Related U.S. Application Data

(60) Provisional application No. 61/941,157, filed on Feb. 18, 2014.

(51) Int. Cl.
*F41A 15/00* (2006.01)
*F42B 39/02* (2006.01)
*F41A 9/64* (2006.01)

(52) U.S. Cl.
CPC *F42B 39/02* (2013.01); *F41A 9/64* (2013.01)

(58) Field of Classification Search
CPC ..... F42B 39/02
USPC ..... 42/90, 106; 220/23.83, 23.86; 224/101, 224/582, 583, 197, 191, 660, 682
See application file for complete search history.

(56) References Cited

U.S. PATENT DOCUMENTS 6,154,997 A * 12/2000 Aluotto ..... F41C 33/02 224/239
6,202,908 B1 * 3/2001 Groover ..... F42B 39/02 224/236
2010/0276463 A1 * 11/2010 Gregory ..... F41C 33/045 224/198
2014/0075650 A1 * 3/2014 Garrison ..... A45F 5/021 2/300
2015/0332604 A1 * 11/2015 Rich ..... F41A 33/00 434/219

* cited by examiner

*Primary Examiner* — J. Woodrow Eldred
(74) *Attorney, Agent, or Firm* — William P. O'Meara, Esq.; Klaas, Law, O'Meara & Malkin, P.C.

(57) ABSTRACT

An assembly for supporting gun magazines includes a plurality of pouches each adapted to receive and hold at least one gun magazine therein. At least one first pivot assembly portion and at least one second pivot assembly portion are mounted on each of the plurality of pouches. A first pivot assembly portion on one pouch is pivotally connectable to a second pivot assembly portion on an adjacent pouch.

10 Claims, 5 Drawing Sheets

GUN MAGAZINE ASSEMBLY

This application claims the benefit of U.S. Provisional Application Ser. No. 61/941,157, filed Feb. 18, 2014, for EXTENDABLE ARTICULATING GUN MAGAZINE POUCH of David George Barwin, which is hereby incorporated by reference for all that it discloses.

BACKGROUND

There are many different kinds of shooting competitions for gun enthusiasts. In some competitions, competitors carrying multiple gun magazines shoot targets, reload, and continue shooting. The speed at which a competitor is able to change magazines in this competition is important to score well. To reload a semiautomatic pistol, a competitor must remove an empty magazine from the pistol and replace it with a full magazine. To do this quickly, competitors need to carry their extra magazines in a convenient and readily accessible place.

SUMMARY

This specification discloses a gun magazine pouch assembly that includes a plurality of pouches that are each adapted to receive and hold at least one gun magazine therein. First and second pivot assembly portions are provided on each of the pouches. The first and second pivot assembly portions on adjacent pouches may be selectively pivotally connectable to provide an articulating assembly that conforms to the body shape of a person wearing the gun magazine pouch assembly. The pouches are modular allowing pouches to be easily added to or removed from the gun magazine pouch assembly. Lateral spacing adapters of different sizes enable the spacing between pouches to be precisely adjusted.

DETAILED DESCRIPTION

Figure 1:
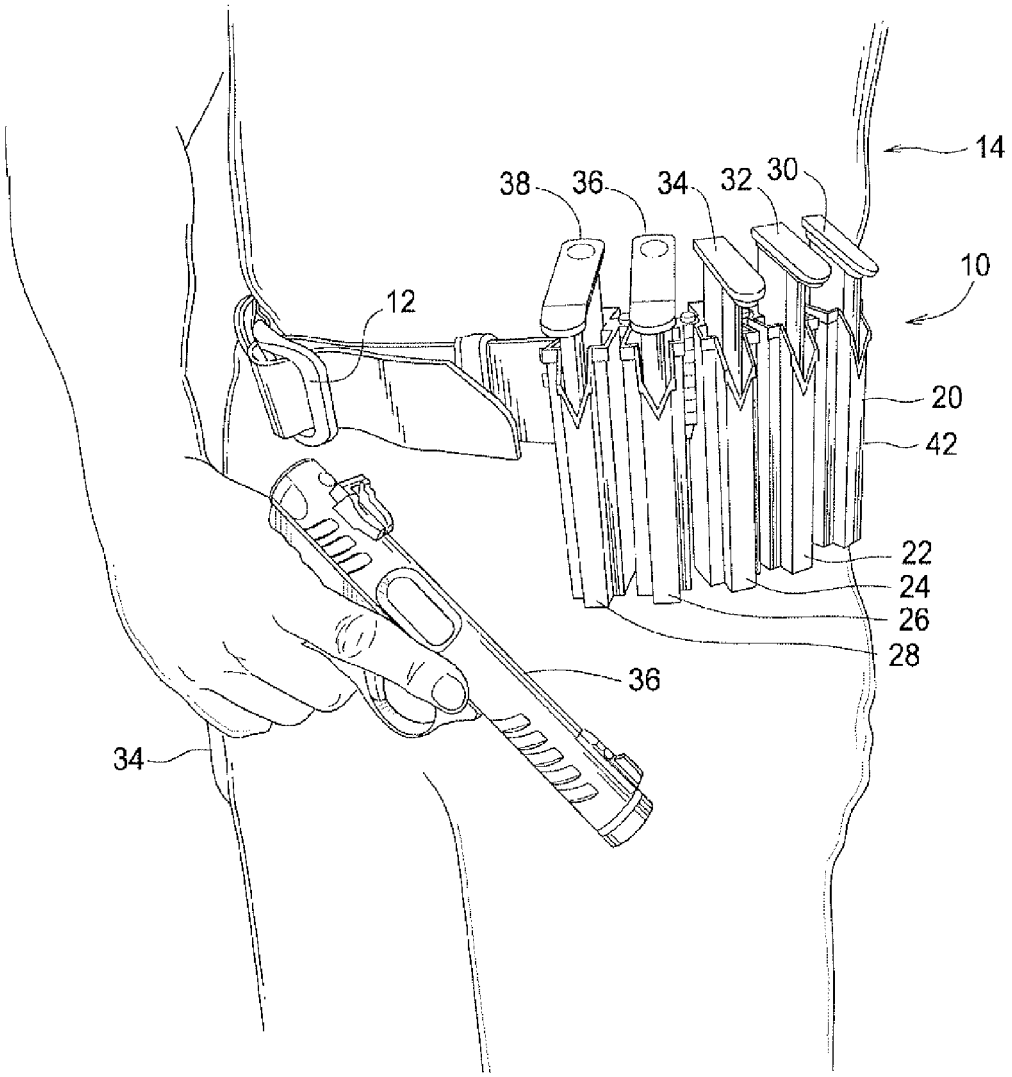
FIG. 1 is an isometric view of a person wearing a gun magazine pouch assembly containing gun magazines.

FIG. 1 is an illustration of a person 14 wearing a gun magazine pouch assembly 10. The assembly 10 has a plurality of interconnected gun magazine pouches 20, 22, 24, 26, 28. Gun magazines 30, 32, 34, 36, 38 are removably supported in the respective pouches. The gun magazine pouch assembly 10 may include a flexible strap 12, such as a belt or bandelaro. A holster 34 for a pistol 36 may also be mounted on the strap 12.

Figure 2:
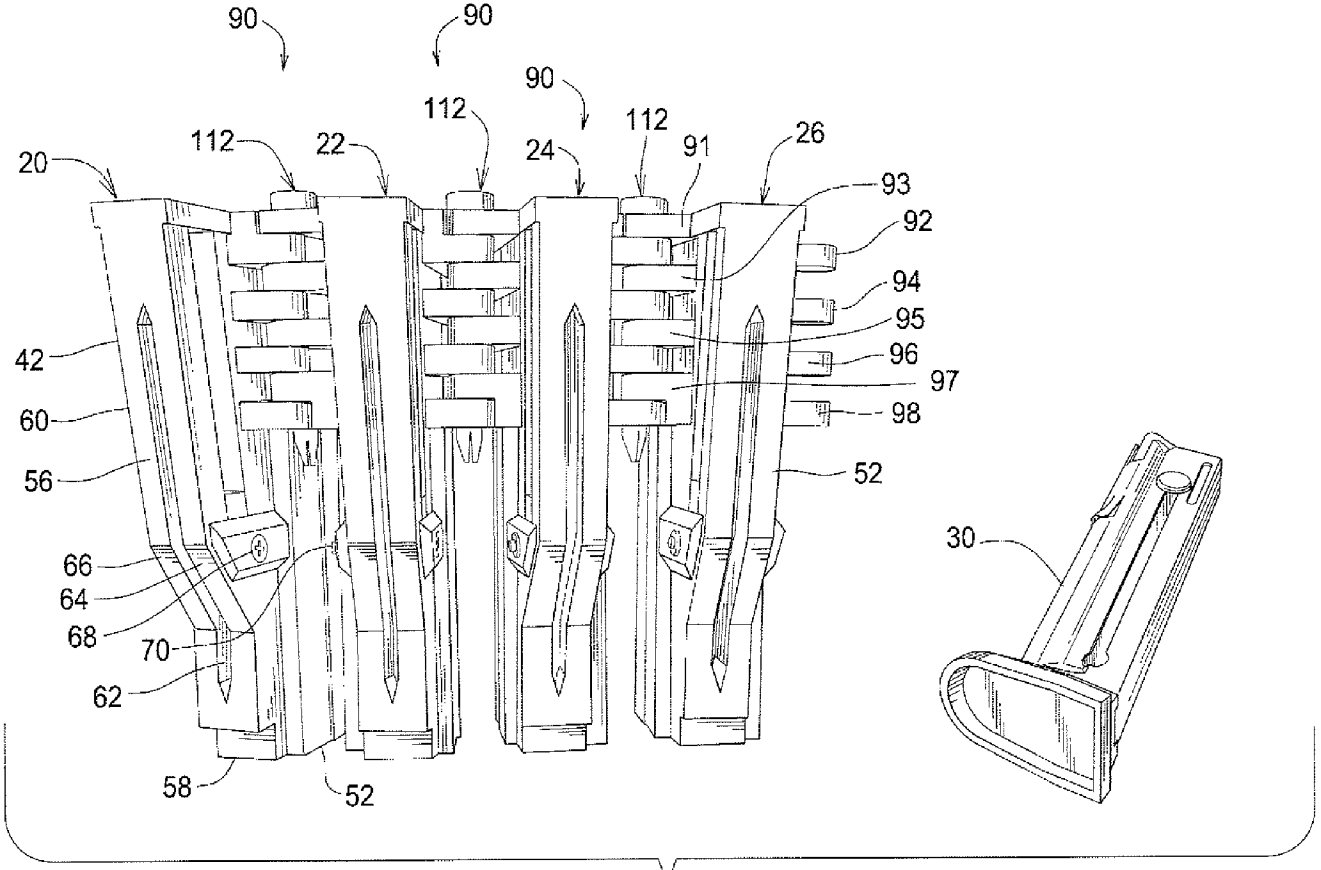
FIG. 2 is a rear isometric view of a plurality of interconnected gun magazine pouches and a gun magazine that is insertable into one of the pouches.
Figure 3:
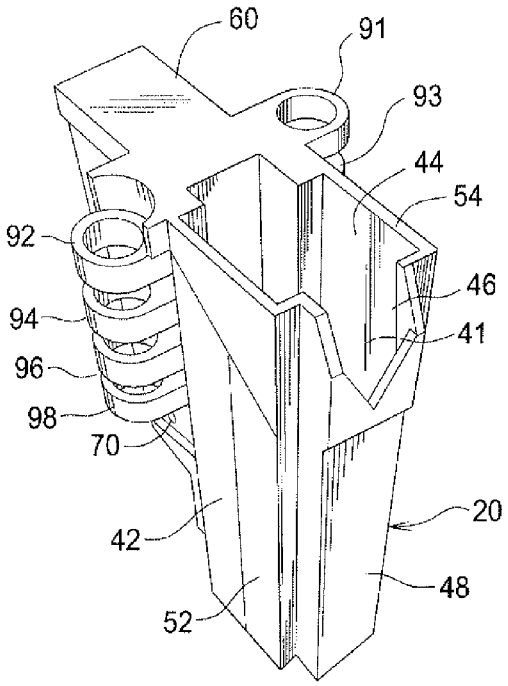
FIG. 3 is a top-front isometric view of a gun magazine pouch.

FIG. 2 is a rear isometric view of the plurality of interconnected gun magazine pouches 20, 22, 24, 26, 28 and a gun magazine that may be inserted into one of the pouches. FIG. 3 is a top front isometric view of one of the gun magazine pouches.

With reference to FIGS. 1-3, each gun magazine pouch, for example pouch 20, has an elongated housing portion 42 that defines an interior cavity 41 adapted to slidingly receive a gun magazine, e.g. magazine 30. The dimensions of each pouch 20 are dependent upon the dimensions of the magazine 30 that it is adapted to receive. The elongated pouch housing portion 42 has a top opening 44 which provides access to the interior cavity 41. The housing portion 42 may also have a front opening 46 intersecting the top opening. The front opening 46 may be patterned to accommodate the shape of a gun magazine 30 that is to be received in the cavity 41.

Figure 4:
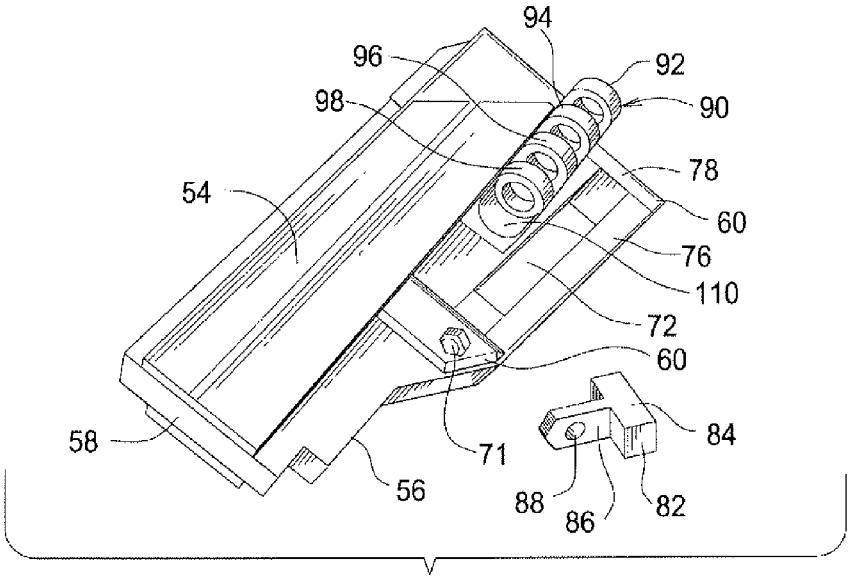
FIG. 4 is a bottom, rear-left isometric view of a gun magazine pouch also showing a spacer for a belt adapter that has been removed therefrom.

Each gun magazine housing portion 42 has a front side 48, opposite lateral sides 52, 54, a backside 56 and a bottom side 58. In some embodiments the bottom is closed, as shown in FIG. 4. Alternatively, the bottom side may be open. A belt/strap adapter 60 is integrally formed on the backside 56 of each pouch housing portion 42, projecting rearwardly therefrom. The belt adapter 60 has a central, vertically extending slit 62 dividing the rear portion of the belt adapter into mirror image first and second sides 64, 66. A bolt 68 extends through a countersunk hole 71, FIG. 4, in the belt adapter 60. A nut 70 may be threadingly tightened on the bolt 68 to selectively tighten or loosen the engagement between the housing portion 42 and a gun magazine 30 received therein. Other structures to facilitate receiving and holding a gun magazine 30 within the housing portion 40, such as for example a detent assembly (not shown), may also be provided.

The belt adapter 60 has a belt receiving opening 72 therein defined by a forward, vertically extending portion 74 a rear, vertically extending portion 76, a top horizontally extending portion 78 and a bottom horizontal extending portion 80. As best shown by FIG. 4, a plurality of differently sized spacer members may be provided for changing the size of the belt adapter opening 70. In one embodiment a spacer member 82 has an upper block shaped portion 84. Block shaped portion 84 has a vertical connector portion 86 having a bolt receiving hole 88 therein. The bolt receiving hole 88 is aligned with a countersunk hole 71 in the belt adapter. The bolt 68 and nut 70 may be used to retain the spacer member 82 in fixed relationship with the belt opening 72. In one embodiment multiple spacer members such as member 82 are provided with differently sized block portions 84, in order to provide a number of differently sized belt openings 72. In another embodiment (not shown) the vertical connector portion 86 is relatively longer than that shown in FIG. 4 and has a number of holes therein to enable adjustable positioning of the space remember.

Figure 5:
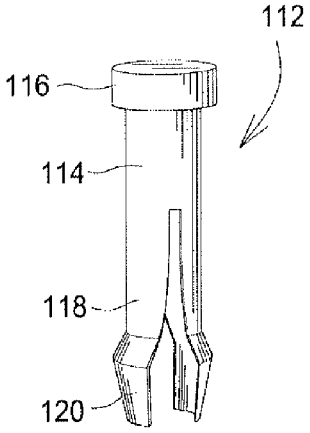
FIG. 5 is an isometric elevation view of a post member used to attach gun magazine pouches.

A pouch coupling assembly 90, as illustrated in FIG. 2, may include a first plurality of axially aligned and spaced apart ring portions 92, 94, 96, 98 positioned on one lateral side 52 of a pouch. A second plurality of axially aligned and spaced apart ring portions 91, 93, 95, 97 are provided on the other side 54 of the pouch. The ring portions 92, 94, 96, 98 on each pouch are adapted to fit between the ring portions 91, 93, 95, 97 of an adjacently positioned pouch enabling the two pouches to be connected in articulating relationship. The articulating relationship between adjacent pouches, e.g., 20 and 22, facilitates wearing of the pouches 20, 22, etc., about a person's waist, as illustrated in FIG. 1. Ring portions 92, 94 etc., maybe formed on a flat surface 110 on one lateral side of the pouch, and the opposite side ring portions 91, 93, etc., may be formed on a mirror image flat surface on the other lateral side of the pouch. A post member 112 may be inserted into aligned ring portions 91, 92, 93, 94, 95, etc. to pivotally couple adjacent pouches, e.g. 20, 22, together. The post member 112, FIG. 5, in one embodiment, has a cylindrical body portion 114, an enlarged head portion 116, and a split lower body and tip portions 118, 120. The opposite sides of the split lower body and tip portions are resiliently inwardly deflectable from the position shown in FIG. 5. During insertion of the post member 112 the ring portions 91, 92, etc. urge the two split sides together until the tip projects from the bottom most ring member 98 and expands into a locking position. The post member tip portion 120 may be easily pinched together to enable the post member 112 to be removed from the ring portions to decouple the adjacent pouches.

Figure 6:
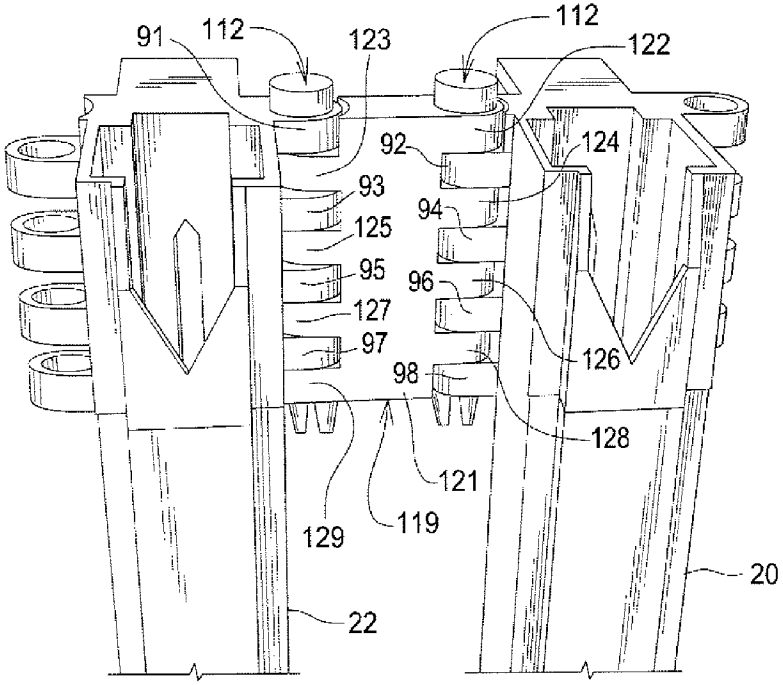
FIG. 6 is an isometric frontal elevation view of a lateral spacing adapter coupling two gun magazine pouches.

FIG. 6 is an isometric frontal elevation view of a lateral spacing adapter 119 pivotally coupling two gun magazine pouches 20, 22. The lateral spacing adapter 119 has a central body portion 121, a first plurality of aligned ring portions 123, 125, 127, 129 on one lateral side of central body portion 121 and a second plurality of aligned ring portions 122, 124, 126, 128 on the other lateral side thereof. Pouch 22 ring portions 91, 93, 95, 97 are positioned between and aligned with corresponding adapter ring portions 123, 125, 127, 129. Pouch 20 ring portions 92, 94, 96, 98 are positioned between and aligned with corresponding adapter ring portions 122, 124, 126, 128. A first and second post 112 is extended through the aligned ring portions of the pouches 20 and 22 and the two sets of aligned ring portions on the lateral spacing adapter 119. The pouches 20, 22 in FIG. 6 are thus relatively pivotable with respect to each other about the two vertical axes provided by the two posts 112. Lateral spacing adapters 119 having central body portions of different widths may be used for precise lateral spacing adjustment. Similarly, two or more lateral spacing adapters 119 which are pivotally coupled together may be attached to two pouches, e.g., 20, 22, for lateral spacing adjustment and to provide additional pivot axes between the pouches.

Figure 7:
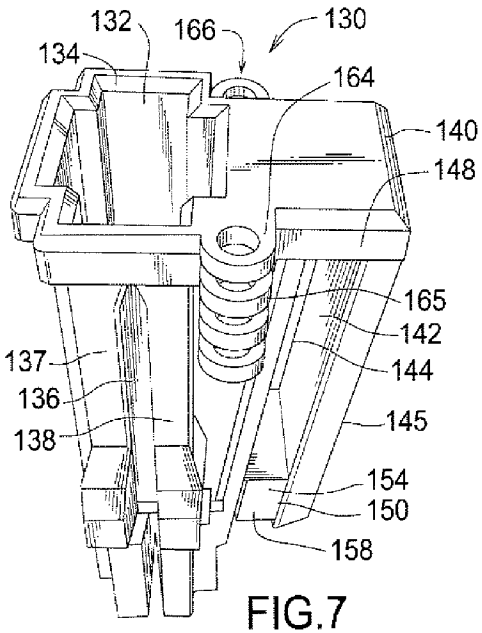
FIG. 7 is a top-left isometric view of another embodiment of a gun magazine pouch.

FIG. 7 illustrates another embodiment of a modular pouch 130. The configuration of the pouch embodiment illustrated in FIG. 7 is sometimes referred to herein as a "discrete configuration," as opposed to the "proud configuration" shown in FIGS. 1-4. In the discrete configuration each pouch has an interior cavity 132 with its longer lateral dimension extending parallel to a belt on which it is mounted. In the proud configuration of FIGS. 1-4, the longer dimension extends perpendicular to the belt on which the pouch is mounted. Since the discrete configuration projects outwardly from a person's waist less than the proud configuration, it is typically more comfortable to wear when a person has a garment, such as a jacket, covering the pouches 130. The proud configuration, because the smaller internal cavity dimension extending parallel to a person's belt, enables the mounting of more pouches in a given belt length than the discrete configuration.

Figure 7A:
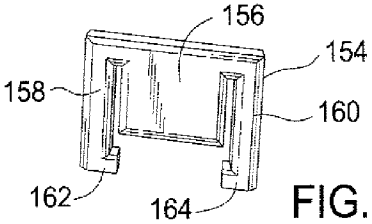
FIG. 7A is a removable belt opening spacer for the gun magazine pouch of FIG. 7.

As further illustrated by FIG. 7, the interior cavity 132 of the pouch 130 has a top opening 134 through which a gun magazine 30 may be inserted. The pouch 130 has first and second lateral side portions 137, 138. A vertical slit 136 is provided inside portion 137. A nut and bolt tightening assembly 139 extends perpendicular to the slit 136 to enable reducing or enlarging the size of the interior cavity 132. A belt adapter 140 is integrally formed on a rear portion of the modular pouch 130. The belt adapter 140 has a belt receiving opening 142 defined by the belt adapter's opposite vertically extending side portions 144, 145 and upper and lower horizontally extending portions 148, 150. A removable spacer member 154 forms part of the lower horizontal portion 150. The spacer member 154 is removably attachable to a fixed horizontal portion (not shown) that is integrally formed with the two side portions 144, 145. FIG. 7A is an isometric view of the spacer member 154, which may be a snap fit member having a central body portion 156 with outwardly deflectable leg portions 158, 160 integrally formed with the body portion 156. Each leg portion has an inwardly projecting foot portion 162, 164 that is adapted to hook underneath a lip structure (not shown) of a fixed structure (not shown) of the lower horizontal portion 150 that may have a generally T-shaped cross section. Variously sized spacer members like spacer member 154 may be provided to accommodate different belt widths. Four vertically aligned ring portions 164 are provided on a flat surface 165 between the belt adapter 140 and the structure forming the pouch cavity 132 on one lateral slide of the pouch 130. Associated ring portions 166 are provided on the opposite lateral side of the pouch. These ring portions 164, 166 and associated posts 112 function to connect adjacent pouches 130, etc., in the same manner as ring portions 91, 92, 93, 94, etc., previously described with reference to FIGS. 1-4.

Figure 8:
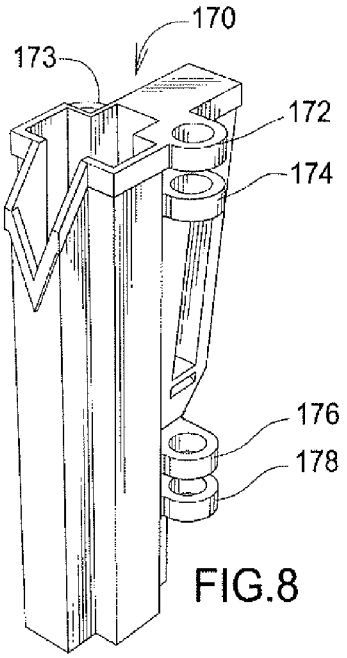
FIG. 8 is a top, front-left isometric view of yet another embodiment of a gun magazine pouch.

FIG. 8 is a top front isometric view of yet another embodiment of a gun magazine pouch 170. The structure of pouch 170 may be generally the same as the structure of gun magazine pouches 20, 22, etc., described with reference to FIGS. 1-4. However, in the embodiment of FIG. 8, the pouch 170 may have a different configuration of ring portions. An upper set of ring portions 172, 174 is positioned above a lower set of ring portions 176, 178 on one lateral side of the pouch 170. An associated set of ring portions 173, etc., adapted to mesh with the first set of ring portions is provided on the opposite lateral side of the pouch 170. In this embodiment upper sets 172, 174 and lower sets 176, 178 are widely vertically spaced and a separate connector post is used to connect each set. A plurality of pouches identical to pouch 170 may be mounted on a belt and interconnected in the same manner as the pouches 20, 22, etc., described above with reference to FIGS. 1-4.

Figure 9:
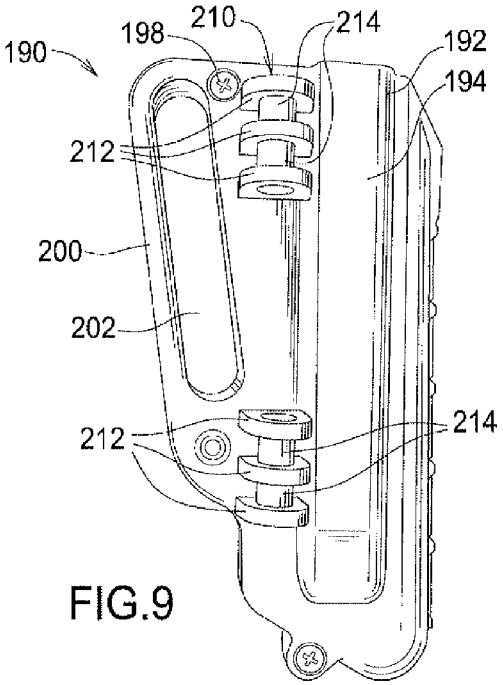
FIG. 9 is a right side elevation view of still another embodiment of a gun magazine pouch.
Figure 10:
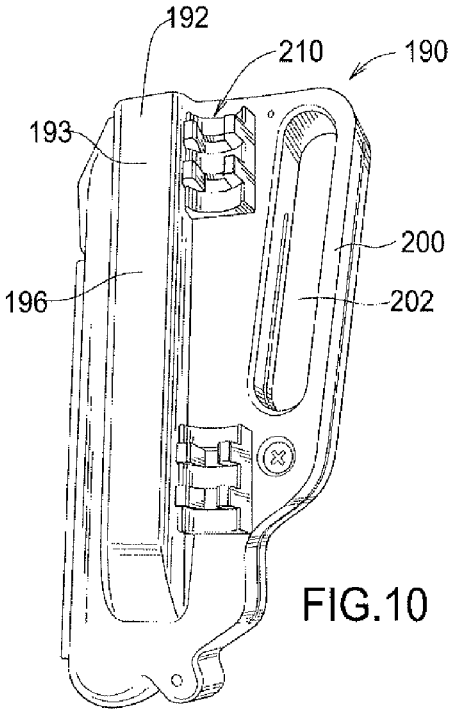
FIG. 10 is a left side elevation view of the gun magazine pouch of FIG. 9.

FIG. 9 is a side elevation view of still another embodiment of a modular gun magazine pouch assembly190. FIG. 10 is an opposite side elevation view of the gun magazine pouch of FIG. 9. The gun magazine pouch 190 has a housing portion 192 defining a gun magazine holding cavity 193, which may be generally the same size and shape as the interior cavity 41 described above with reference to FIG. 3. Gun magazine pouch 190 has two generally mirror image lateral sides 194, 196 that are connected together, such as by screws or nuts and bolts 198. A belt adapter 200 defining a belt receiving opening 202, projects from the rear of the housing body portion 192. The modular gun magazine pouch 190 has a coupling assembly 210 for connecting it to identical gun magazine pouches. The pouches 190 are modular in that they are identical and can easily be used for replacement of a damaged pouch or extension/expansion of a pouch assembly by simply adding another pouch. The module coupling assembly 210 includes, on the lateral side shown in FIG. 9, a plurality of horizontally projecting shelves 212 in a first cluster at an upper part of the housing and an identical set of shelves 212 in a second cluster at a lower part of the housing. Post portions 214 extend between adjacent shelves 212 in both the upper and lower clusters. As shown in FIG. 10, the coupling assembly 210 further includes a plurality of arcuate, resilient clip shaped portions 216, that are vertically spaced apart and adapted to resiliently clippingly engage vertical post portions, such as post portions 214, that are provided on an adjacent gun magazine pouch, which may be identical to pouch 190. The two adjacent pouches may be clipped together by urging the clip shaped portions 216 on one pouch against associated post portions 214 on the other pouch. The adjacent pouches may be decoupled by moving the clip shaped portions 216 away from the post portions 214 until the clip portions resiliently expand and release the post portions.

Figure 11:
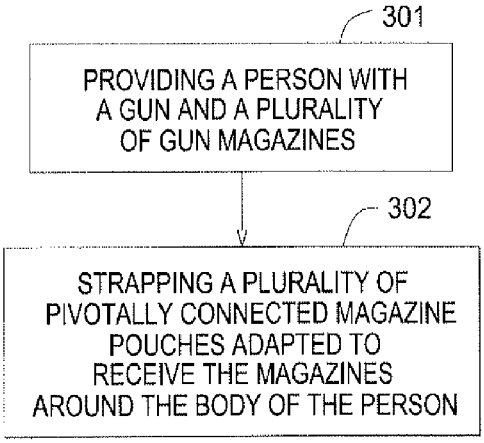
FIG. 11 is a flow chart of a method of shooting.

FIG. 11 is a flow chart of a method of shooting. The method comprises, as shown at block 301, providing a person with a gun and a plurality of gun magazines. The method further includes, as shown at block 302, strapping a plurality of pivotally connected magazine pouches, which are adapted to receive the magazines, around the body of the person.

Although certain embodiments of an extendable, articulating gun magazine pouch assembly have been described in detail herein, alternative embodiments of such a gun magazine pouch assembly will occur to those skilled in the art after reading this disclosure. It is intended for the language of the appended claims to be construed broadly to cover such alternative embodiments, except as limited by the prior art.

What is claimed is:

1. An assembly for supporting gun magazines comprising:

a plurality of pouches each having a housing portion adapted to receive and hold at least one gun magazine therein;

at least one first pivotal coupling portion mounted on each of said plurality of pouches;

At least one second pivotal coupling portion mounted on each of said plurality of pouches said first and second pivotal coupling portions being selectively pivotally connectable and disconnectable.

2. The assembly of claim 1 further comprising at least one post receivable in aligned ones of said first and second pivotal coupling portions of adjacent ones of said plurality of pouches to pivotally attach said first and second pivotal coupling portions.

3. The assembly of claim 1 wherein at least one of said plurality of pouches comprises a strap adapter.

4. The assembly of claim 3 wherein said strap adapter comprises a strap receiving opening and an opening adapter mounted within said opening to change the size of the opening.

5. The assembly of claim 4 comprising a plurality of opening adapters for use in association with straps of different widths.

6. The assembly of claim 1 wherein said housing portions each comprise a slit therein that may be selectively widened or narrowed to adjust the fit of said housing portion with a gun magazine received in said housing portion.

7. The assembly of claim 3, each of said assemblies comprising a strap, each housing portion having a top opening with a larger dimension measured in a first direction and a smaller dimension measured in a second direction perpendicular to said first direction.

8. The assembly of claim 7 wherein said larger dimension extends generally parallel to said strap.

9. The assembly of claim 7 wherein said larger dimension extends generally perpendicular to said strap.

10. The assembly of claim 9 wherein at least one of said first and second coupling portions comprises a plurality of aligned ring portions.

* * * * *